United States Patent [19]

Amsler et al.

[11] 4,444,242

[45] Apr. 24, 1984

[54] MODULAR SHUTTER FOR WINDOWS OR THE LIKE

[75] Inventors: Bruno Amsler, Olten; Daniel Voney, Schönenwerd; Josef Koch, Aarau; Alfred Frei, Schönenwerd, all of Switzerland

[73] Assignee: Emil Schenker AG, Schönenwerd, Switzerland

[21] Appl. No.: 307,081

[22] Filed: Sep. 29, 1981

[30] Foreign Application Priority Data

Oct. 6, 1980 [DE] Fed. Rep. of Germany ..... 3037725

[51] Int. Cl.[3] ..... E06B 9/30

[52] U.S. Cl. ..... 160/172

[58] Field of Search ..... 160/166–178

[56] References Cited

U.S. PATENT DOCUMENTS

| | | | |
|---|---|---|---|
| 2,874,771 | 2/1959 | Muhr | 160/172 |
| 3,520,346 | 7/1970 | Green | 160/172 |
| 3,578,060 | 5/1971 | Spencer | 160/172 |
| 3,651,852 | 3/1972 | Neri | 160/172 |

*Primary Examiner*—Peter M. Caun

*Attorney, Agent, or Firm*—Peter K. Kontler

[57] ABSTRACT

A modular shutter is assembled of prefabricated components and of yard goods or piece goods which are cut to size at the locale of use. The components of the shutter include two upright guide rails for the end portions of a curtain of upwardly and downwardly movable as well as tiltable slats, a horizontal main shaft between the upper end portions of the guide rails, a housing mounted on top of each guide rail and having bearings for the corresponding end portions of the main shaft, a motor or a crank drive for rotating the main shaft clockwise or counterclockwise, and combined lifting and tilting mechanisms in the housings. Such mechanisms have lifting bands which are connected with the end portions of the slats to effect upward or downward movements of the slats in response to rotation of the main shaft in one or the other direction, and tilting bands which change the angular positions of the slats in response to selected rotation of the main shaft.

36 Claims, 14 Drawing Figures

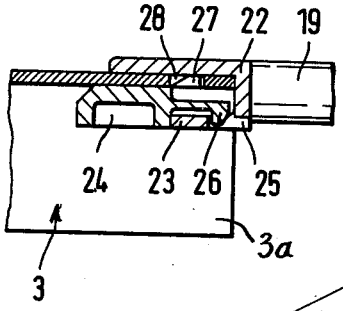
FIG. 3
FIG. 2
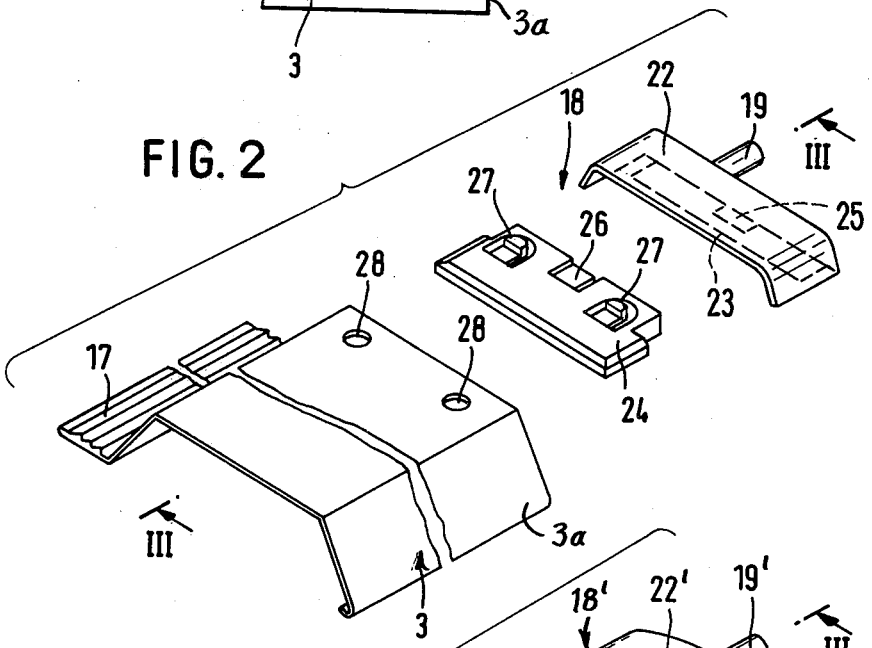
FIG. 2a
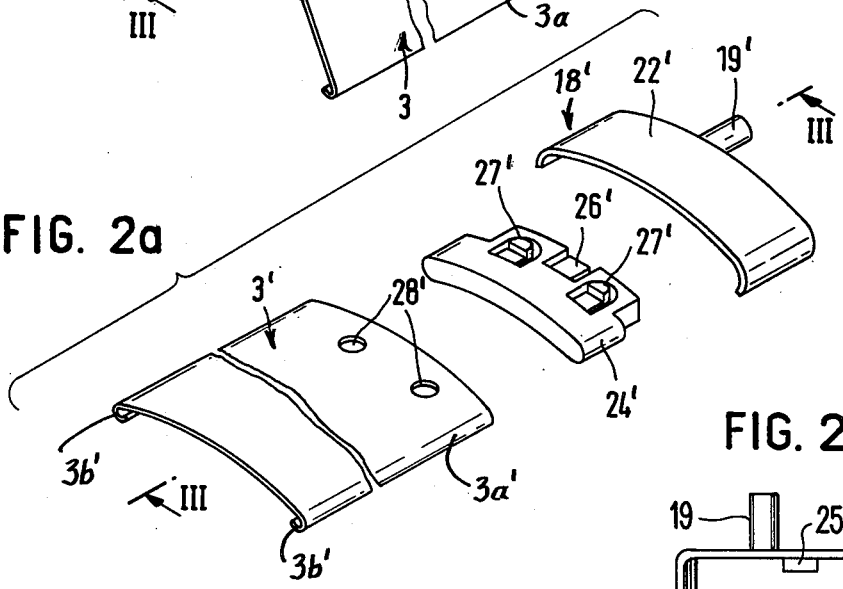
FIG. 2b
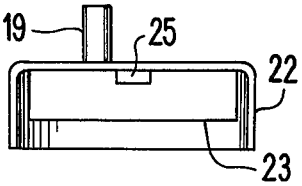

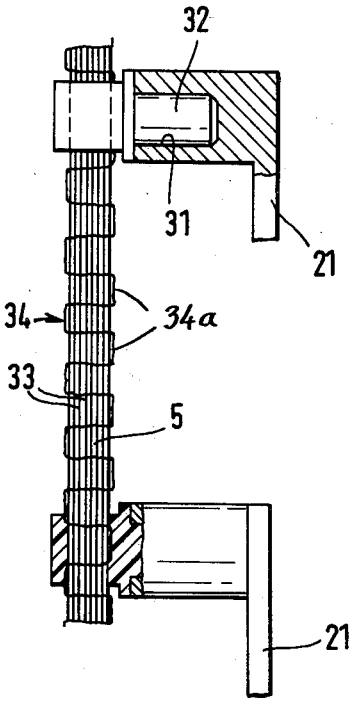
FIG. 4
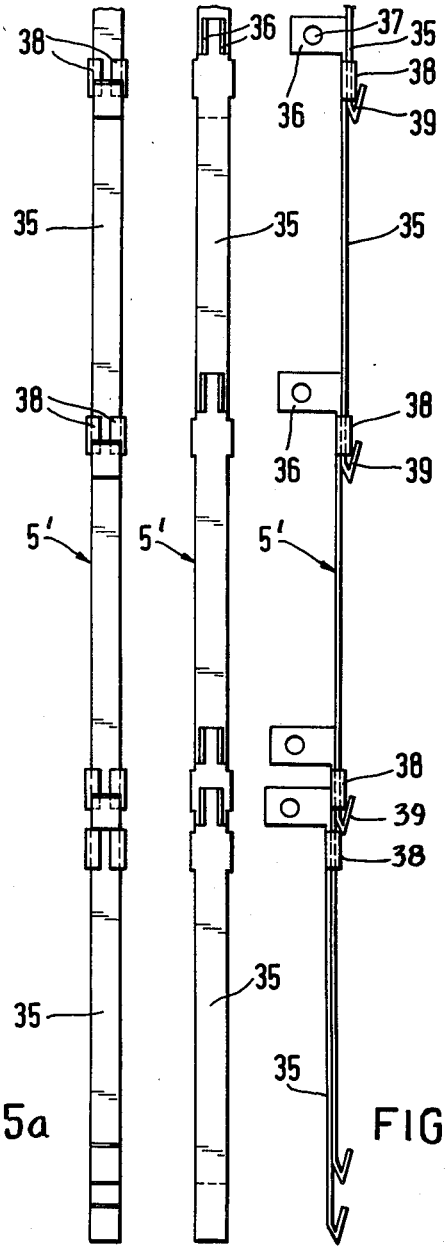
FIG.5a
FIG. 5b
FIG.5c

MODULAR SHUTTER FOR WINDOWS OR THE LIKE

BACKGROUND OF THE INVENTION

The present invention relates to shutters for windows, doors or the like in general, and more particularly to improvements in shutters of the type wherein a curtain of lammellae or slats is movable up and down between two upright frame members and the upper end portions of the frame members are adjacent to a rotary main shaft which can be driven to move the slats up or down.

A drawback of presently known shutters of the above outlined character is that each and every shutter must be "tailored" to suit the dimensions of the particular window or door, i.e., that the maker of shutters or a competent employee of a shutter making concern must inspect the locale of proposed installation of the shutter, measure the width, depth and height of the opening in which the shutter is to be installed, and thereupon proceed with the making of a shutter which can be fitted into the corresponding opening. This is a time-consuming operation so that the cost of shutters is high, especially if they must be produced in relatively small numbers. As a rule, the maker of shutters or his representative visits the locale of installation after the building is partially erected, i.e., subsequent to erection of the walls which are provided with openings for the windows and doors. Such mode of ascertaining the exact dimensions of shutters prior to installation in an office building, private home, bank, store or an analogous establishment entails the making of sets of shutters at intervals which are dictated by the erectors of buildings, that is, the maker of shutters cannot manufacture large numbers of shutters for inventory, i.e., for installation into new buildings when the need arises. In other words, and since each and every shutter is a tailor-made assembly of parts which can only be installed in a selected or predetermined opening, the manufacturer of shutters cannot keep any or can maintain only limited supplies of prefabricated shutters or prefabricated shutter parts. Still further, and if an employee happens to make a mistake or is negligent or superficial during measuring of an opening which is to receive a shutter, the maker of shutters is likely to suffer pronounced losses as a result of replacement of improperly manufactured shutters with satisfactory shutters and/or lengthy repair work on an improperly dimensioned shutter. Thus, there exists an urgent need for shutters which can be mass produced at reasonable cost and which can be installed in a time and labor-saving operation.

OBJECTS AND SUMMARY OF THE INVENTION

An object of the invention is to provide a novel and improved shutter which can be assembled, at least in part, of prefabricated mass-produced components so that its initial and/or assembly cost is but a small fraction of the corresponding cost involved in the making and/or assembly of a conventional shutter.

Another object of the invention is to provide a shutter of the just outlined character which can be transported to the locale of use at a fraction of the cost of transport of conventional shutters.

A further object of the invention is to provide a shutter which can be assembled, in a time-saving operation, by semiskilled or unskilled persons.

An additional object of the invention is to provide a shutter which can be readily installed in a window or door opening even if the dimensions of such opening were not ascertained prior to transport of the shutter to the locale of use.

Still another object of the invention is to provide a shutter which need not be assembled, even in part, in the manufacturing plant and which can be readily tailored to suit the dimensions of the corresponding opening by resorting to skilled, semiskilled or even unskilled labor.

Another object of the invention is to provide novel and improved component parts which can be assembled into a shutter of the above outlined character.

A further object of the invention is to provide a shutter which need not be replaced if certain of its component parts do not immediately fit into the opening or cavity in which the shutter is to be installed.

Another object of the invention is to provide a shutter which is just as versatile, rugged and eye-pleasing as heretofore known shutters but can be manufactured and assembled at a small fraction of the cost of conventional shutters.

One feature of the invention resides in the provision of a modular shutter for installation in door openings, window openings or the like. The shutter comprises a kit or set of prefabricated components including a set of liftable and pivotable slats having end portions, guide rails for the end portions of the slats and housings attached to the upper end portions of the guide rails. The components have and/or the kit includes quick make-and-break connections for attachment of the components to each other.

The guide rails extend upwardly and flank the curtain of slats therebetween. The aforementioned components of the kit further include a horizontal rotary main shaft having first and second end portions which are received in the bearings of housings on the upper end portions of the guide rails. Each of the housings preferably constitutes a discrete component of the kit, and at least one of the housings further includes lifting and pivoting or tilting means for the slats. The aforementioned connections include means for non-rotatably securing the lifting means to the respective end portion of the main shaft.

The kit can further comprise a shroud which overlies or confines at least a portion of the main shaft between the housings, and the aforementioned connections include or may include clamping means for securing the shroud to at least one of the housings.

A further component of the kit can include a gear case which is separably connected with the main shaft and includes or confines means for rotating the main shaft. In such shutters, the gear case can be coupled to a further component which constitutes a means for rotating the shaft through the medium of bevel gears or another suitable angular drive in the gear case. For example, the bevel gears can be rotated by a manually actuable drive, such as a crank drive. The gear case can be attached to one of the housings by plugs and sockets, by screws, by bolts or by other suitable securing means.

The main shaft can also be rotated automatically, e.g., by a reversible prime mover mounted on top of the guide rails or connected to an end portion of the main shaft, for example, through the medium of a suitable clutch, coupling or other torque transmitting means.

The novel features which are considered as characteristic of the invention are set forth in particular in the appended claims. The improved shutter itself, however, both as to its construction and the mode of assembling and operating the same, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged exploded perspective view of a holder for one end portion of a slat in the shutter of FIG. 1;

FIG. 2*a* is a similar exploded perspective view of a holder for the end portion of a modified slat;

FIG. 2*b* is a bottom view of a cover member and detent constituting part of the holder of FIG. 2;

FIG. 3 is a sectional view as seen in the direction of arrows from the line III-III of FIG. 2, with certain parts of the respective holder in assembled condition and connected to the end portion of the slat;

FIG. 4 is an enlarged fragmentary elevational view of a band which can be used to change the inclination of slats in the shutter of FIG. 1, and further showing portions of levers which form part of slat holders and are separably connected with the tilting band;

FIG. 5*a* is a fragmentary rear elevational view of a modified tilting band;

FIG. 5*b* is a fragmentary front elevational view of the band which is shown in FIG. 5*a;*

FIG. 5*c* is a fragmentary side elevational view of the band which is shown in FIGS. 5*a* and 5*b;*

DESCRIPTION OF THE PREFERRED EMBODIMENTS

Figure 1:
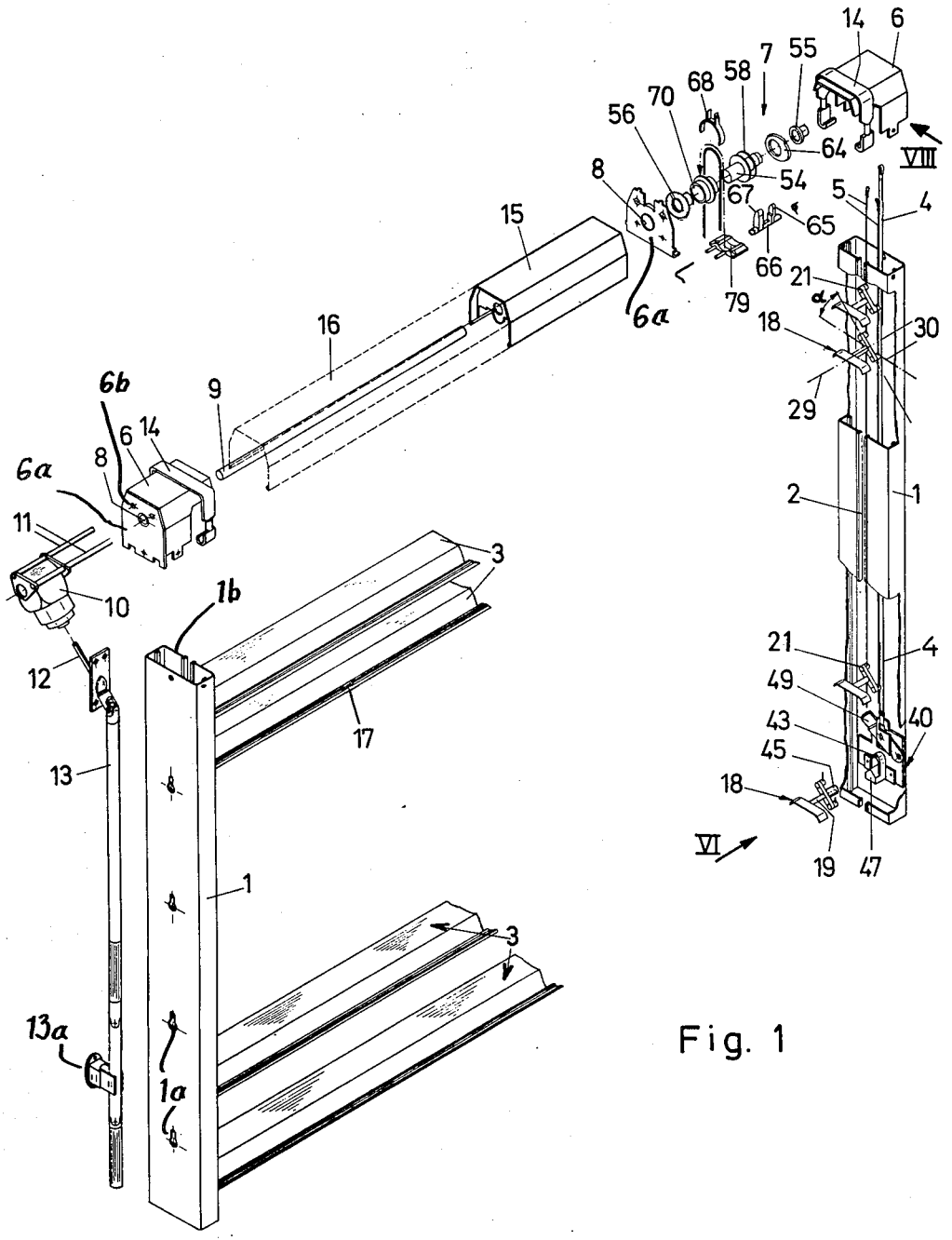
FIG. 1 is a fragmentary exploded perspective view of a shutter which embodies one form of the invention.

Referring first to FIG. 1, there is shown a portion of a novel and improved shutter in an exploded perspective view. The shutter constitutes a kit of prefabricated components many of which can be cut to size and all of which can be assembled at the locale of use, e.g., in a building where the shutter is to be installed in a window opening, a door opening or the like. Two component parts of the kit constitute elongated hollow boxlike sheet metal guide rails 1 each of which has an elongated guide slot 2. When the guide rails 1 are properly installed in the respective opening, the two slots 2 are aligned with and face each other so that they can adequately guide suitably configurated end portions or holders of a curtain of normally parallel horizontal slats or lamellae 3. The manner in which the guide rails 1 can be affixed to the building forms no part of the present invention; nevertheless, FIG. 1 showns by way of example that the outer wall of the left-hand guide rail 1 has a row of aligned apertures or slots 1*a* each of which has a wider or larger lower portion and a smaller or narrower upper portion. Thus, the heads of nails, screws or bolts which are driven into the material surrounding the opening can be inserted into the larger portions of the apertures 1*a* whereupon the respective guide rail 1 is caused to descend so that the shanks of the screws, nails or bolts enter the narrower upper portions of the apertures and the heads of such fasteners hold the rail against movement away from the nearest surface surrounding the window or door opening.

Each of the guide rails 1 defines an upright compartment 11*b* which receives portions of at least two tapes, bands, cords, ropes or analogous elongated flexible elements, namely, a lifting tape or band 4 which can be convoluted onto a pulley or reel to thereby lift the curtain of slats 3, and at least one tilting or inclination-changing tape or band 5 which can be manipulated by the occupant of the room or automatically to close, partially open or fully open the curtain of slats 3. As a rule, the shutter will comprise two pairs of tilting bands 5, one pair for each of the two guide rails 1. The compartments 1*b* are not accessible when the shutter is installed, i.e., the guide rails 1 then shield those portions of the bands 4 and 5 which are confined in the respective compartments 1*b*. The height of the window or door in which the shutter is installed determines the length of the guide rails 1 and of the bands 4 and 5. The guide rails 1, as well as the bands 4 and 5, may be manufactured as yard goods, i.e., in lengths slightly or greatly exceeding those which are necessary for a single shutter, and can be subdivided or cut to necessary lengths at the locale of use to fit the dimensions of the selected opening, i.e., to enable the person in charge to assemble a shutter of desired height. The bands 4 and 5 can be severed by shears or analogous tools. On the other hand, a saw will normally be employed to cut to size or subdivide a relatively long guide rail into several guide rails 1 of desired or optimum length.

The kit which is shown in FIG. 1 further comprises a pair of bracket-like housings 6 each of which can constitute (either alone or with the parts mounted therein and/or thereon) a discrete component part of the kit. As shown, the housings 6 are designed in such a way that they can be slipped onto or into the upper end portions of the respective guide rails 1 and are more or less permanently (but preferably releasably) connectable to the corresponding guide rails 1 by one or more quick make-and-break connections of special design or of any conventional construction or make. For example, such quick make-and-break connections may include screws, bolts, interlocking parts, wedge-like parts, pop rivets or any other connectors which can couple two separable parts to each other in response to rotation of one part with reference to the other part, in response to application of pressure (such as in a snap-on or snap-in connection), in response to relative sliding movement and/or a combination of such movements.

At least one of the housings 6 accommodates a combined lifting and tilting mechanism 7, and each such mechanism includes one of the aforementioned bands 4 as well as a pair of bands 5. While it is presently preferred to employ mechanisms 7 each of which employs or cooperates with two tilting bands 5, it is equally possible to utilize one of the two bands 5 as a means for changing the inclination of slats 3 and to use the other band 5 as a means for supporting the respective end portions of the slats 3, e.g., as a means for carrying the weight of pivot pins or stub shafts which are or can be provided at the end portions of the slats 3 and extend into the compartments **1*b* through the respective slots 2. If one of the bands 5 constitutes a means for supporting the end portions of the slats 3, the shutter is preferably designed in such a way that its slats 3 tend to assume their closed or at least partly closed positions under the action of gravity. This can be readily achieved by dimensioning the slats 3** in such a way that they tend to turn in a direction toward the closed positions when they are not acted upon by a force other than gravity and their end portions are carried by the just discussed supporting bands.

At least one of the housings 6 preferably further confines suitable means for limiting the extent of angular movement of slats 3 between fully open and fully closed positions. Such limiting means may include limit switches or mechanical stops of conventional design. Reference may be had to the commonly owned copending patent application Ser. No. 294,157 filed Aug. 19, 1981 by Bruno Amsler for "Motor-driven shutter with emergency lifting means for slats". The disclosure of this copending application is incorporated herein by reference. The limiting means may form part of or they may cooperate with the corresponding lifting and tilting mechanism or mechanisms 7, depending upon whether such limiting means are provided in a single housing 6 or in each of these housings. However, it is equally within the purview of the invention to provide specially designed (auxiliary) housings (note the parts 15 and 16) which can be installed adjacent to the housings 6 and serve the sole purpose or the additional purpose of confining and shielding the corresponding limiting means. A suitable limiting means will or may comprise a feed screw which rotates with a horizontal main shaft 9 extending between the housings 6. The feed screw meshes with a nut which is held against rotation so that it moves axially of the feed screw when the main shaft 9 is rotated manually or automatically. If the main shaft 9 is rotated automatically the nut cooperates with two limit switches each of which can terminate movement when it is actuated by the nut. If the main shaft 9 is rotated manually (e.g., by a crank drive), the nut cooperates with two spaced-apart fixed stops each of which simply prevents further rotation of the main shaft by the crank drive when engaged by the oncoming nut. The just discussed auxiliary housing or housings for the limiting means can be installed next to or in the interior of the adjacent housing or housings 6.

The housings 6 have outer walls **6*a* with bearings 8 for the respective end portions of the main shaft 9. The latter constitutes a further discrete component part or constituent of the kit and can be cut to size at the locale of use, the same as the guide rails 1 and bands 4 and 5**.

A further discrete component part of the kit is a gear case 10 which is adjacent to the left-hand housing 6 of FIG. 1 and has two parallel prongs 11 insertable into complementary holes or sockets **6*b* in the end wall 6*a*. The gear case 10 confines an angular gear, e.g., a pair of mating bevel gears one of which is coaxial with and drives the respective end portion of the main shaft 9 when the latter is properly inserted into the respective bearing 8 and the gear case 10 is properly attached to the corresponding housing 6. The one bevel gear can have a hollow shaft which is non-rotatably slipped onto the adjacent end portion of the main shaft 9 when the prongs 11 are properly received in their sockets 6*b*. This ensures that the angular gear in the gear case 10 is ready to rotate the shaft 9 in response to rotation of the other bevel gear which can receive torque from a manually actuable crank drive 13 having an output element 12 which can be inserted into the hollow shaft of the other bevel gear in the gear case 10. The gear case 10 can be shifted lengthwise of the main shaft 9 and can be installed at the left-hand end or at the other end of the shaft 9. The prongs 11 may constitute or may be replaced with threaded connectors in the form of screws or bolts which serve to separably but reliably secure the gear case 10 to the selected housing 6**.

The output element 12 may constitute an elongated rod of polygonal (e.g., square) cross-sectional outline and fits into a complementary bore in the shaft for the other bevel gear in the gear case 10 to rotate such bevel gear (and hence the main shaft 9) in response to actuation of the crank drive 13 which, when not in use, can be releasably inserted into a U-shaped holder **13*a***.

If the main shaft 9 is driven automatically, the crank drive 13 as well as the gear case 10 can be omitted. Alternatively, the parts 10 and 13 are then replaced with an emergency slat lifting device, e.g., a device of the type disclosed in the aforementioned copending application Ser. No. 294,157 of Amsler. The purpose of the emergency lifting device is to enable the occupant or occupants of the room to lift the curtain of slats 3 when required.

The median portion of the main shaft 9 is or can be confined in a further component part of the kit which may constitute a relatively short truncated frame or shroud 15 or a longer frame or shroud 16 (shown by broken lines). The shroud 15 will be used when the main shaft 9 is rotatable manually, such as by the aforediscussed parts in the gear case 10 and by the crank drive 13. This shroud can accommodate the aforediscussed feed screw which forms part of or is rotatable by the main shaft 9, the aforementioned nut which meshes with the feed screw but is nonrotatably held in and movable lengthwise of the shroud 15, and the aforediscussed fixed stops for the nut. Each of the shrouds 15, 16 can be made of sheet metal and may have a substantially U-shaped profile or cross section. The shroud 15 or 16 can be separably secured to the adjacent housing or housings 6 by one or more clamps 14 or other suitable quick make-and-break connections.

If the main shaft 9 is rotatable automatically, a relatively small prime mover may be used. This may be installed in the interior of the frame or shroud 16 and preferably includes a hollow cylindrical or tubular output shaft which is slipped onto the main shaft 9 so that the latter is rotated in the direction of the output shaft. If the shutter employs the shroud 16, such shroud can also confine the feed screw, the nut which constitutes a trip, and two limit switches which can be actuated by the trip in a manner known from the art of motor-driven shutters and shown in the aforementioned application of Amsler.

The shroud 15 and/or 16 can be furnished in the form of a long blank which is brought to the locale of use and cut to size by a saw or another suitable implement. The same holds true for the main shaft 9 as well as for the slats 3, especially if the slats are constructed in a manner as shown in FIGS. 2, 2*a* and 3, namely, so that they are connected with detachable slat holders and include profiled main portions which can be supplied in the form of yard or piece goods and cut to size in the building in which the shutter is to be installed. Severing of the main shaft, shroud 15 or 16 and/or slats 3 and/or guide rails 1 to desired size at the locale of use presents no problems, even to a semiskilled or more or less unskilled person, such as a tinker who wishes to install a shutter in his or her home without professional help.

FIGS. 1, 2 and 3 show one type of slat (3) which can be utilized in the shutter of the present invention. As can be readily seen in FIGS. 1 and 2, each slat 3 has a substantially trapezoidal (angular) profile with a single marginal ledge the upper side of which is coated with a layer 17 of damping (shock-and sound-absorbing) material such as rubber or an elastomeric synthetic plastic substance. The ledge of an upper slat 3 comes to rest on the damping layer 17 of the slat 3 therebelow in certain angular positions of such slats. Slats 3 of the type shown in FIG. 2 are presently preferred for use in relatively wide shutters, i.e., in shutters wherein the upright guide rails 1 are disposed at a relatively large distance from each other, because the profiles of the slats 3 enhance their resistance to torsional and other stresses. Resistance to torsional stresses is desirable because the slats 3 are less likely to vibrate in draft or when exposed to wind and are also less likely to produce unpleasant rattling or other noise.

Each end portion of each slat 3 is mounted in a discrete slat holder or carrier 18 only one of which is shown in full detail in FIGS. 2 and 3. Each slat holder 18 may constitute a discrete component part or constituent of the aforementioned kit. Thus, the slats 3 can be cut to size at the locale of use, and each end portion of each slat 3 is then provided with or connected to a holder 18 which enables the respective end portion to be adequately guided along the corresponding guide rail 1.

Each slat holder 18 comprises a first portion which is detachably coupled to the adjacent end portion 3*a* of the respective slat 3 and a second portion extending through the adjacent slot 2 and into the compartment 1*b* of the corresponding guide rail 1. The second portion comprises a pivot pin 19 which is a relatively short stub shaft insertable through and slidable in one of the slots 2. That end portion of the pivot pin 19 which extends through the adjacent slot 2 and into the compartment 1*b* of the respective guide rail 1 is affixed to or made integral with a two-armed lever 21 (see FIGS. 1 and 4) so that the lever 21 shares all angular movements of the respective pivot pin 19 and vice versa. Each arm of the lever 21 is connected with one of the two tilting bands 5 in the respective compartment 1*b*. However, and if one of the bands 5 merely serves to support the respective end portions of the slats 3, the two-armed levers 21 are replaced with one-armed levers whose free ends are connected with the single tilting band 5 in the respective compartment 1*b*. The other band 5 then performs (or can perform) the function of maintaining the end portions of the slats 3 at an optimum distance from each other, i.e., of maintaining the pivot pins 19 at a uniform distance from each other, as considered in the longitudinal direction of the respective guide rail 1 (at least when the curtain of slats 3 is fully extended)

Each pivot pin 19 is connected with a plate-like cover member 22 and with a male detent member or projection 23. The members 22 and 23 are spaced apart from each other, as considered in the radial direction of the pivot pin 19, so as to provide room for insertion of the respective end portion 3*a* of the corresponding slat 3 (see FIG. 3). When the end portion 3*a* is properly inserted between the members 22 and 23, the cover member 22 overlies the top as well as portions of the sides of the end portion 3*a*. Furthermore, once the end portion 3*a* is properly inserted between the members 22 and 23, the underside of the cover member 22 abuts and bears against the adjacent portions of the upper side of the end portion 3*a*. Each slat holder 18 further comprises a discrete insert 24 which is adapted to be slipped between the underside of the end portion 3*a* and the detent member 23. The configuration of the insert 24 is such that its upper side contacts the adjacent portion of the underside of the end portion 3*a* when the holder 18 is assembled with the respective slat 3. The width of the insert 24 matches or approximates the width of the flat central portion of the cover member 22. Thus, a properly inserted end portion 3*a* is clamped between the cover member 22 and the corresponding insert 24. The means for releasably connecting the detent member 23 with the properly installed insert 24 comprises a detent notch 25 in the detent member 23 and a complementary pallet or an analogous protuberance 26 on the insert 24. The pallet 26 is elastic so that it first yields and thereupon snaps into the notch 25 of the member 23 in response to movement of the insert 24 to its final position with reference to the pivot pin 19. The quick make-and-break connection between the detent member 23 and the insert 24 can be terminated by applying pressure against the pallet 26 from below, as viewed in FIG. 3, so as to expel the pallet from the notch 25 of the detent member 23. The operator is then free to withdraw the insert 24 preparatory to separation of the end portion 3*a* from the parts 19, 22 and 23.

In order to prevent unintentional detachment of the end portion 3*a* of a slat 3 from the respective holder 18, e.g., when the curtain of slats 3 is lowered and a slat strikes an obstruction in the path of its movement toward the lower end position so that the lowermost slat tends to leave its normal horizontal position of parallelism with the main shaft 9, the insert 24 is provided with two transversely spaced upwardly extending protuberances 27 which are preferably elastic or are mounted on short elastic arms and can snap into complementary openings 28 in the end portion 3*a* of the slat 3. This ensures that the end portion 3*a* is positively but separably connected with the insert 24, and that the latter is positively but separably connected with the pivot pin 19, namely, with the detent member 23 which is rigid or integral with the pivot pin. It can be said that the parts 23, 25, 26 provide a form-locking connection between the pivot pin 19 and the insert 24, and that the parts 27, 28 provide or establish an analogous form-locking connection between the insert 24 and the end portion 3*a* of the slat 3. The end portion 3*a* is held between the cover member 22 and the insert 24 without any clearance or with negligible clearance to thereby further reduce the likelihood of twisting and/or the generation of noise. The extent of frictional engagement between the end portion 3*a* on the one hand and the member 22 and insert 24 on the other hand is or can be so pronounced that, even in the absence of protuberances 27 and openings 28, the holder 18 adheres to the slat 3 also when the latter encounters an obstruction during lowering of the curtain, namely, an obstruction which tends to move the axis 29 of the lowermost slat away from a position of parallelism with the axis of the shaft 9 and thereby tends to extract the end portion 3*a* from the space between the cover member 22 and insert 24.

Since the connection between the holder 18 and the slat 3 is not permanent, such connection can be readily terminated to allow for replacement of a damaged or defective slat and/or slat holder.

The positions of the protuberances 27 and openings 28 can be reversed. Also, it is possible to provide a single opening 28 in the end portion 3*a* or in the insert 24 and a single protuberance 27 on the insert 24 or on the end portion 3*a*. Still further, it is possible to provide one or more openings 28 and one or more protuberances 27 on each of the parts 3*a* and 24.

The holder 18' for the end portion 3*a'* of the slat 3' shown in FIG. 2*a* is analogous to the holder 18. The only difference is that the curvature of the cover member 22' and insert 24' is changed so as to conform to that of the end portion 3*a'* of the slat 3'. The lateral portions of the cover member 22' are suitably bent so as to overlie the rounded or partially rounded beads 3*b'* which constitute the marginal portions of the slat 3'. All such parts of the slat holder 18' which are identical with or clearly analogous to the corresponding parts of the slat holder 18 are denoted by similar reference characters each of which is followed by a prime. The slat 3' is less resistant to torsional stresses (unless its material is thicker or more rigid than the material of the slat 3) and is more likely to become twisted, to vibrate in the wind and/or to generate rattling or other noises. However, the slat 3' can be manufactured at a cost which is a fraction of or at least slightly less than the cost of a slat 3.

The holders 18 and 18' contribute to stability of the respective curtain, i.e., they enhance the resistance of the respective slats 3, 3' to torsional stresses. This allows for the utilization of relatively long slats, i.e., for the making of shutters with wide curtains fitting into large or extra large door or window openings.

Referring again to FIG. 1, the two-armed levers 21 of the slat holders 18 make relatively small acute angles alpha with the general planes 30 of the respective slats 3. The reference character 29 denotes in FIG. 1 the axis of the respective pivot pin 19, i.e., the axis about which the respective slat 3 can be tilted between open, partly open and closed positions. The just mentioned inclination of each lever 21 with reference to the corresponding plane 30 causes the neighboring slats 3 to abut against each other (i.e., the ledges of upper slats can come to rest on the damping layers 17 of the slats 3 therebelow) under the action of gravity. However, it is equally possible to locate the levers 21 in or in parallelism with the planes 30 of the respective slats 3.

The free end portions of the arms of levers 21 are formed with holes or sockets 31 for extruded synthetic plastic studs 32 which are fixedly secured to the corresponding tilting bands 5 and are a friction fit in the respective sockets 31. If desired, the studs 32 can be movably secured to the respective tilting bands 5 but with pronounced friction so that they are unlikely to change their positions in the longitudinal direction of the respective tilting band. The studs 32 are equidistant from each other, as considered in the longitudinal direction of the respective tilting band or bands 5. When a tilting band 5 is cut to size from a longer band, it already carries a set of equidistant studs 32, and such studs are then inserted into the sockets 31 of the corresponding levers 21 to establish a reliable frictional or snap-in connection between the tilting bands 5 and the slats 3, i.e., the tilting bands can be used to turn the slats 3 about the respective axes 29 to thereby change the inclination of the planes 30 of slats 3 with reference to a horizontal plane.

An advantage of the sockets 31 and studs 32 is that the connections between the bands 5 and the end portions of levers 21 can be established or terminated in a simple and time-saving manner without resort to any tools. Moreover, the spacing between the studs 32 on the bands 5 is such that the slats are automatically held at an optimum distance from each other when the sockets 31 receive the studs 32. This is important to a tinker or to a person employed by the maker or installer of shutters and having only a minimum of technical background or skill.

FIG. 4 shows that each tilting band 5 may constitute a strip or web of textile or other filamentary material. In the embodiment of FIG. 4, the tilting band 5 includes a set of longitudinally extending warp threads 33 preferably consisting of readily flexible steel wire or like wear-resistant metallic material. The weft 34 is a filament which consists of a wear-resistant synthetic plastic material. When the curtain of slats is lifted, the lateral portions 34*a* of the weft thread 34 lie between the warp threads 33 and the internal surface of the respective guide rail 1 to thus reduce the likelihood of development of scratch marks on the guide rail and prevent scratching noises during lengthwise movement of the band 5.

If desired, the band 5 of FIG. 4 can be replaced with a highly flexible steel rope or cord which may but need not be provided with a noise-reducing envelope or sheath.

Bands of the type shown in FIG. 4 can stand pronounced or extremely high tensional stresses without any or with a minimum of stretching. This is especially desirable when the curtain is not only long but is also assembled of long and relatively heavy slats.

FIGS. 5*a*, 5*b* and 5*c* illustrate a portion of a modified tilting band 5' which is assembled of relatively short elongated steel strip sections 35. The sections 35 are coupled to each other in such a way that they can be telescoped into each other in order to shorten the band 5' or moved lengthwise of each other in the opposite direction when the length of the band 5' is to be increased. One end portion (namely, the upper end portion, as viewed in FIGS. 5*a* to 5*c*) of each section 35 has two laterally extending parallel lugs 36 which are formed with registering holes 37 for reception of synthetic plastic studs corresponding to those shown at 32 in FIG. 4. The studs are used to couple the sections 35 to the pivot pins 19 or 19' of slat holders 18 or 18'. The lugs 36 are adjacent to pairs of shorter lugs 38 which are disposed therebelow and are bent to the opposite side of the respective section 35. The configuration of the lugs 38 is such that they form a partly or completely closed loop or eyelet slidably receiving a portion of the adjacent section 35. Thus, each upper section 35 is slidable in the loop 38 of the section 35 therebelow to increase or reduce the combined effective length of such sections. The lower end portion of each section 35 has a bent-over projection 39 which resembles a hook and serves to prevent extraction of the respective section 35 from the loop 38 of the section 35 therebelow. FIG. 5*c* shows that the three upper hooks 39 abut against the neighboring loops 38 which means that the combined effective length of the corresponding sections 35 has been increased to a maximum value. When the combined length of two neighboring or interengaging sections 35 is reduced to a minimum, the loops 38 of such sections 35 are closely or immediately adjacent to each other. This is shown in the lower part of FIG. 5*c*.

The composite band 5' of FIGS. 5*a* to 5*c* can be used with advantage when the intrados of window or door openings are narrow so that it is necessary to reduce the dimensions of the two upright guide rails.

The sections 35 can be mass-produced in the form of stampings. Furthermore, such sections can be made of a suitable synthetic plastic material by extrusion, injection molding or any other mass-production technique. If the sections 35 are made of a metallic material, their ductility should be sufficient to allow for bending of the portions 36, 38 and 39 upon completion of the stamping operation.

Figure 6:
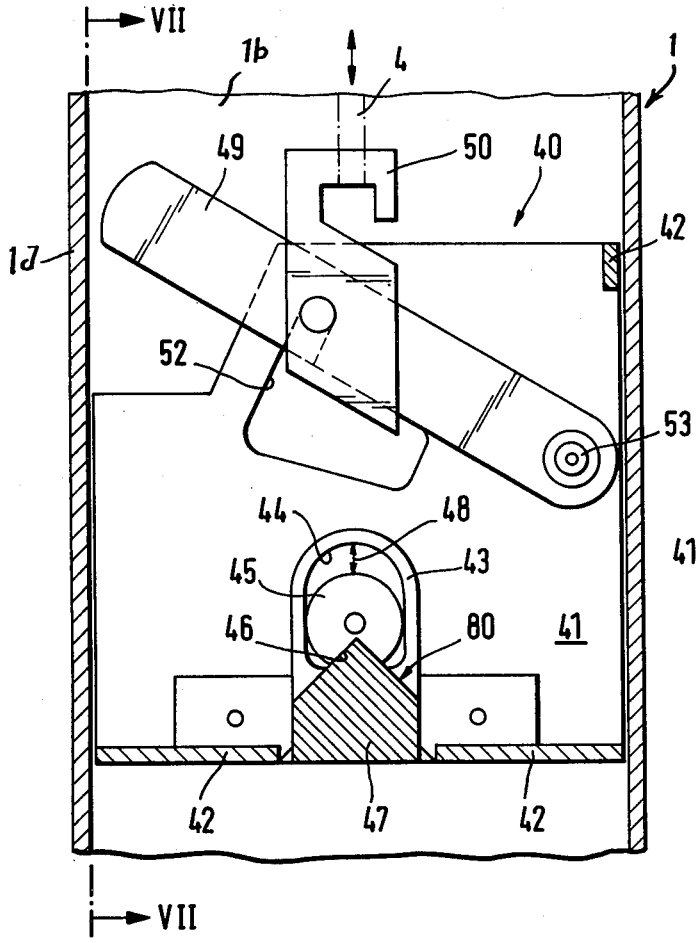
FIG. 6 is an enlarged view as seen in the direction of arrow VI in FIG. 1, showing (in partial vertical sectional view) a carriage which is connected with the lower end portion of a flexible slat lifting device and supports stabilizing or levelling means for the corresponding end portion of the lowermost slat.
Figure 7:
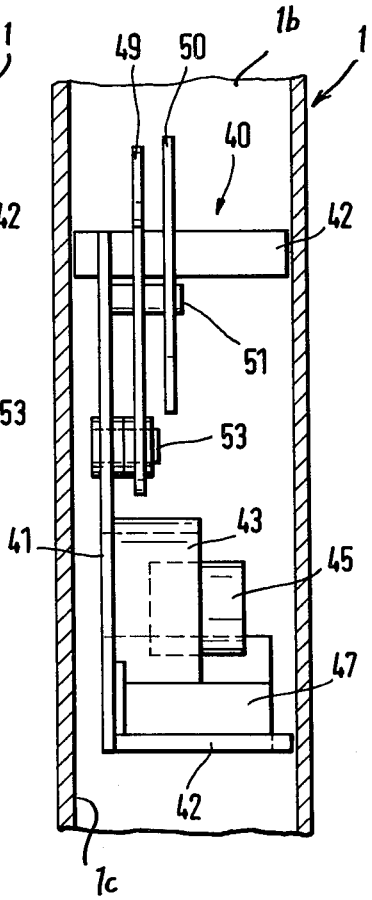
FIG. 7 is a sectional view as seen in the direction of arrows from the line VII-VII of FIG. 6.

As shown in FIGS. 1, 6 and 7, the lower end portions of the lifting bands 4 are not attached directly to the lowermost slat 3 or 3' and/or to the holders 18 or 18' for the lowermost slat but rather to a pair of carriages or slides 40 which are reciprocable in the corresponding compartments 1*b*. Each carriage 40 comprises a flat plate-like body or base 41 which is adjacent to the non-slotted wall 1*c* of the respective guide rail 1, namely, to that wall which is formed with the row of apertures 1*a*. Two or more marginal portions of the base 41 are formed with bent-over portions or legs 42 which abut against and slide along the wall 1*c* as well as along that wall of the respective guide rail 1 which is formed with the continuous slot 2. If it is desired to reduce friction between the carriages 40 and the respective guide rails 1, the legs 42 can be replaced by rolls or wheels.

Each plate-like body or base 41 is provided or connected with a bearing 43 which defines a vertical opening or passage 44 the upper end portion of which is bounded by a substantially semicylindrical internal surface of the bearing 43. The passage 44 receives a stub or stub shaft 45 which is non-rotatably secured to the respective end portion of the lowermost slat 3 or 3'. More particularly, the stub 45 is secured to the lever 21 of the holder 18 or 18' for the respective end of the lowermost slat 3 or 3', and such stub is rotatably and vertically movable in the corresponding passage 44. The underside or lower surface of the stub 45 has an inverted V-shaped groove 46 which, when the stub 45 is caused or allowed to descend in the passage 44, can receive the wedge-like upper portion 80 of a centering stabilizing or levelling element 47 fixedly secured to the plate-like body or base 41 of the respective carriage 40. The upper side of the stub 45 is spaced apart from the aforementioned semicylindrical surface in the upper portion of the passage 44 when the surface bounding the groove 46 contacts the surface on the complementary wedge-like upper portion 80 of the associated stabilizing element or part 47.

The lengths of the lifting bands 4 and tilting bands 5 are selected in such a way that, during lowering of the curtain of slats, the lowermost slat 3 or 3' is already suspended on the fully extended tilting bands 5 while the carriages 40 continue to descend in the corresponding guide rails 1 (note the distance 48 in FIG. 6). This causes the stabilizing parts or elements 47 to move their wedge-like portions 80 downwardly and out of the associated grooves 46, i.e., the centering, stabilizing or levelling stubs 45 are free to turn with reference to the carriages 40 and guide rails 1 when the carriages reach their lower end positions. In other words, the lowermost slat 3 or 3' can turn about its axis 29 when the curtain of slats is fully extended as a result of movement of both carriages 40 to their lower end positions.

Prior to lifting of the curtain of slats, the slats 3 or 3' are pivoted to horizontal or nearly horizontal positions, e.g., by appropriate manipulation of the tilting bands 5. In the next step, and if the operator wishes to reduce the length of the curtain, the lifting bands 4 are pulled automatically or by the crank drive 13 to lift the carriages 40 whereby the wedge-like upper portions 80 of the stabilizing elements 47 enter the adjacent grooves 46 and hold the lowermost slat 3 or 3' against angular movement in the course of the lifting operation. The stabilizing or centering elements 45 and 47 ensure that the planes of the slats 3 or 3' are horizontal or nearly horizontal when the length of the curtain is reduced to a minimum value, i.e., when the lowermost slat 3 or 3' is lifted to its uppermost position. The slats 3 or 3' are horizontal or nearly horizontal when the curtain is lifted, even if the lowermost slat 3 or 3' was rotated from horizontal position in response to impingement upon an obstruction during lifting of the slats. Such orientation of slats 3 or 3' when the curtain of slats is lifted is desirable and advantageous because the shutter is less likely to be damaged during lowering and the slats 3 or 3' cannot become interlaced during lengthening of the curtain if each slat is held in a horizontal position while the curtain is in its raised position. Jamming of the curtain as a result of engagement between neighboring slats would be much more likely if the slats were inclined in the raised position of the curtain.

The plate-like body or base 41 of each carriage 40 is further provided with a horizontal fulcrum or shaft 53 for an elongated blocking lever 49. The length of the lever 49 exceeds the distance between the fulcrum 53 and the opposite end wall 1*d* of the respective guide rail 1. The lever 49 carries a hook-shaped retaining device 50 for the lower end portion of the respective lifting band 4, and a post 51 which extends into an adjacent cutout 52 of the plate-like base 41 and serves as a means for limiting the extent of clockwise angular movement of the blocking lever 49, as viewed in FIG. 6. When the lifting band 4 is taut, i.e., during lifting or lowering of the curtain of slats 3 or 3', the blocking lever 49 assumes the upper end position which is shown in FIG. 6 and in which the post 51 is received in the uppermost portion of the cutout 52. The left-hand end portion or free end of the lever 49 is then remote from the end wall 1*d* so that the lever 49 does not interfere with upward or downward movement of the carriage 40 in the compartment 1*b* of the respective guide rail 1. If the lifting band 4 is slack, e.g., when the curtain of slats 3 or 3' is fully extended or when the lowermost slat is engaged and lifted by hand or by an implement in the partly or fully extended or fully contracted position of the curtain, the free end of the blocking lever 49 descends by gravity to abut against the inner side of the end wall 1*d* (such inner side extends into the path of orbital movement of the free end portion of the blocking lever about the axis of the shaft 53) and thereby jams the carriage 40 in the guide rail 1, i.e., the carriage 40 cannot move upwardly because its resistance to upward movement increases proportionally with the magnitude of force which tends to lift the carriage 40 in a manner other than through the medium of the lifting band 4. Thus, the blocking lever 49 constitutes a very simple but reliable safety feature which prevents unauthorized or undesirable lifting of slats 3 or 3' in a manner other than in the prescribed way, namely, by exerting a pull upon the lifting band 4. The free end portion of this lever assumes a first or upper end position when the band 4 is taut, and a second or lower end position when the band 4 is slack.

It will be noted that the carriage 40 constitutes a means for entraining the lowermost slat during lifting of the curtain of slats 3 or 3', i.e., the bands 4 are not directly connected with the holders 18 or 18' for the lowermost slat.

An advantage of the blocking lever 49 is that it need not be biased by one or more springs. Thus, the free end portion of the lever 49 is automatically disengaged from the end wall 1*d* when the band 4 is under tension, and the weight of the lever 49 suffices to move its free end portion into blocking engagement with the end wall 1*d* as soon as the band 4 allows this lever to pivot by gravity in a counterclockwise direction, as viewed in FIG. 6.

As a rule, the curtain of slats 3 or 3' is confined in a space above the window or door opening when the curtain is moved to its upper end position. The parts (such as 45, 47 and 49) which are mounted on and/or share all or nearly all movements of the carriage 40 are then concealed in such space and are less likely to be contaminated, covered with ice and/or otherwise exposed to adverse climatic conditions.

As stated above, the blocking lever 49 invariably prevents unauthorized direct manual lifting of the lowermost slat, irrespective of the position of the curtain, and this lever prevents unauthorized lifting of any slat when the curtain is fully extended.

FIGS. 1, 8, 9 and 10 show the details of a lifting and tilting mechanism 7. This mechanism is installed in the respective bracket-like housing 6 at the top of the corresponding guide rail 1 and preferably constitutes (with the associated housing 6) a discrete component part of the aforediscussed kit. The mechanism 7 comprises a sleeve-like member 54 which is non-rotatably slipped onto the adjacent portion of the main shaft 9 and whose end portions are rotatable in bearings 55, 56 provided therefor in the housing 6. The sleeve 54 is fixedly connected to or made integral with two spaced-apart flanges 57 which form part of a reel or spool 58 for the corresponding lifting band 4. That portion of the sleeve 54 which extends between the flanges 57 constitutes the core of the reel 58. The flanges 57 are connected with a post 59 which is parallel to the axis of the shaft 9 and serves as an anchoring means for the respective end portion of the corresponding lifting band 4. The core of the reel 58 (i.e., the aforementioned portion of the sleeve 54 between the flanges 57) has an axially parallel open groove or slot 60 (see FIG. 9) which receives one end portion of a resilient element here shown as a substantially Z-shaped spring 61. The tip of this end portion (namely, of the left-hand end portion, as viewed in FIG. 9) extends into a bore provided therefor in the adjacent portion of the sleeve 54. The other end portion of the substantially Z-shaped spring 61 extends through a slot 62 in the respective flange 57 and into a recess 63 provided in a disc-shaped adjusting cam 64 surrounding the sleeve 54 in the region of the bearing 55. The inner end portion of the recess 63 is or resembles an annulus so that it does not interfere with movement of the corresponding end portion of the spring 61 with reference to the cam 64. Thus, in the absence of the corresponding end portion of the spring 61, the cam 64 would always be free to rotate on the sleeve 54. This cam has a non-circular peripheral cam face 64*a* which is tracked by a follower 65 (omitted in FIG. 9) here shown as a lever extending radially from a shaft 66 which is rotatably mounted in the respective housing 6. A torsion spring 66*a* or the like is provided to impart to the shaft 66 a torque in a counterclockwise direction, as viewed in FIG. 10, so as to urge the follower lever 65 against the face 64*a* of the cam 64.

Figure 8:
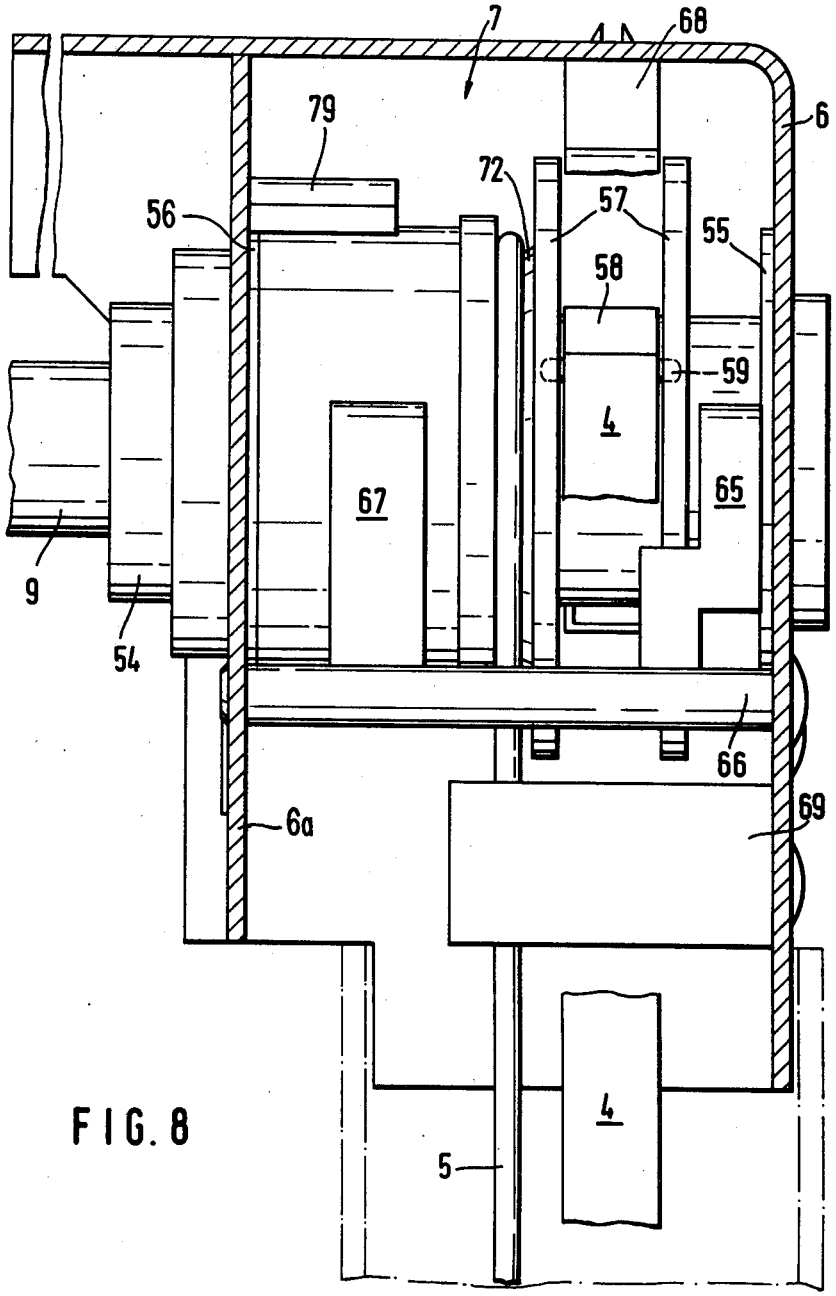
FIG. 8 is an enlarged front elevational view of a combined slat lifting and tilting mechanism in assembled condition as seen in the direction of arrow VIII in FIG. 1 but with the front part of the housing for such mechanism broken away.
Figure 9:
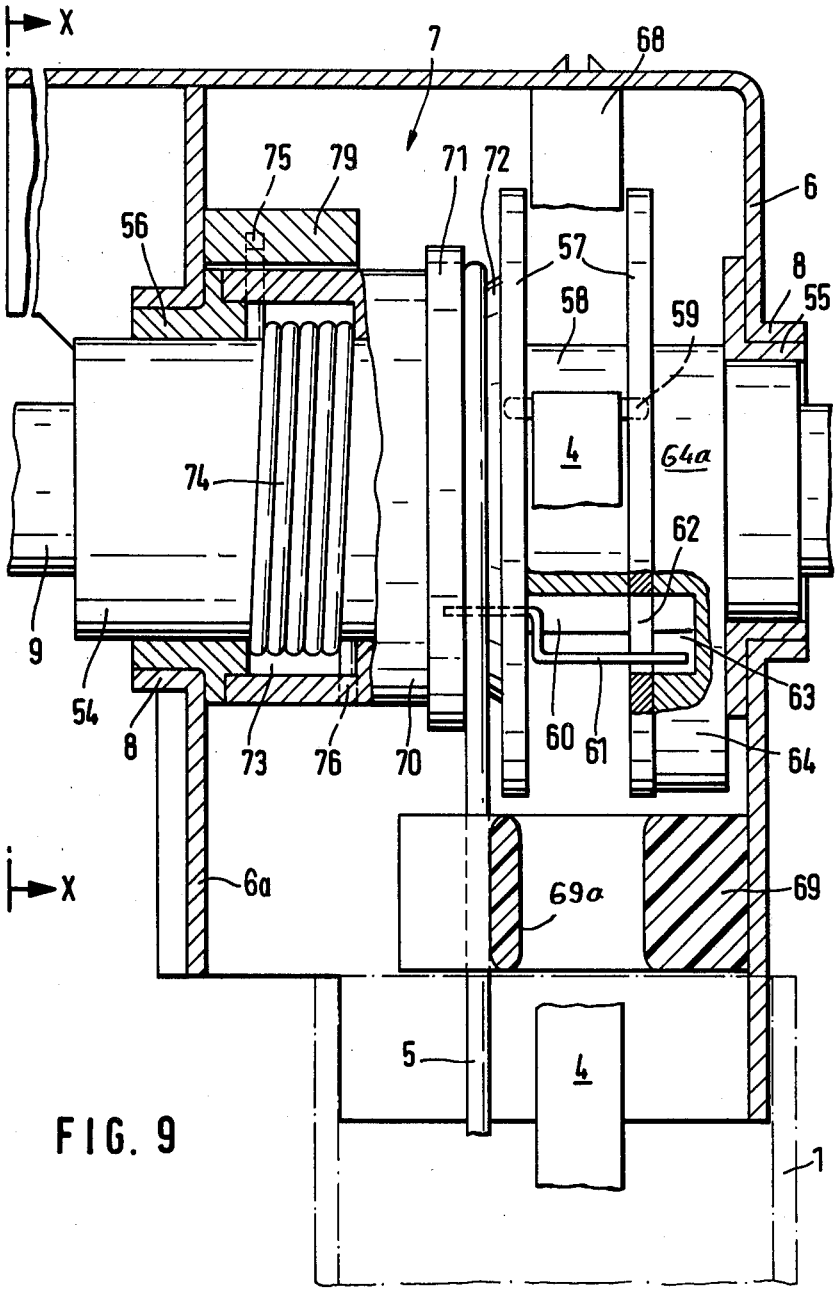
FIG. 9 is a view similar to that of FIG. 8 but with certain parts omitted and certain parts shown in a vertical sectional view.

When the Z-shaped spring 61 assumes the position which is shown in FIG. 9, it establishes a torque-transmitting connection between the reel 58 and the cam 64. Such situation arises when the lifting band 4 is fully unwound from the reel 58 (see FIGS. 8 and 9), i.e., when the curtain of slats 3 or 3' is fully expanded. The upper end portion of the lifting band 4 then extends tangentially or radially of the core of the reel 58, i.e., it is not convoluted onto the sleeve 54 between the flanges 57. If the main shaft 9 is rotated in a direction to collect the lifting band 4 on the reel 58, the convolutions of the band 4 push the spring 61 into the groove 60 of the core of the reel 58 whereby the right-hand end portion of the spring 61 (as viewed in FIG. 9) is disengaged from the cam 64 and the reel 58 can rotate with reference to the cam 64 and/or vice versa.

When the lifting band 4 is fully paid out and the reel 58 rotates with the cam 64 because the spring 61 then establishes a torque-transmitting connection between the sleeve 54 (which rotates with the main shaft 9) and the cam 64, the cam face 64*a* pivots the follower lever 65 which, in turn, rotates the shaft 66. The shaft 66 rotates a further lever 67 which is rigidly connected thereto. The parts 64–66 can be said to constitute a means for adjusting the angular position of the lever 67.

The reel 58 is partially surrounded by a semicylindrical clamp 68 which is affixed to the housing 6 and serves to prevent the lifting band 4 from leaving the space between the flanges 57 of the reel 58. A guide element 69 which preferably consists of a suitable synthetic plastic material is installed at a level below the reel 58 and defines a channel 69*a* for the passage of the lifting band 4. The element 69 is also secured to the housing 6 and is adjacent to the upper end portion of the respective guide rail 1. The channel 69*a* can further serve to guide the tilting band or bands 5.

Figure 10:
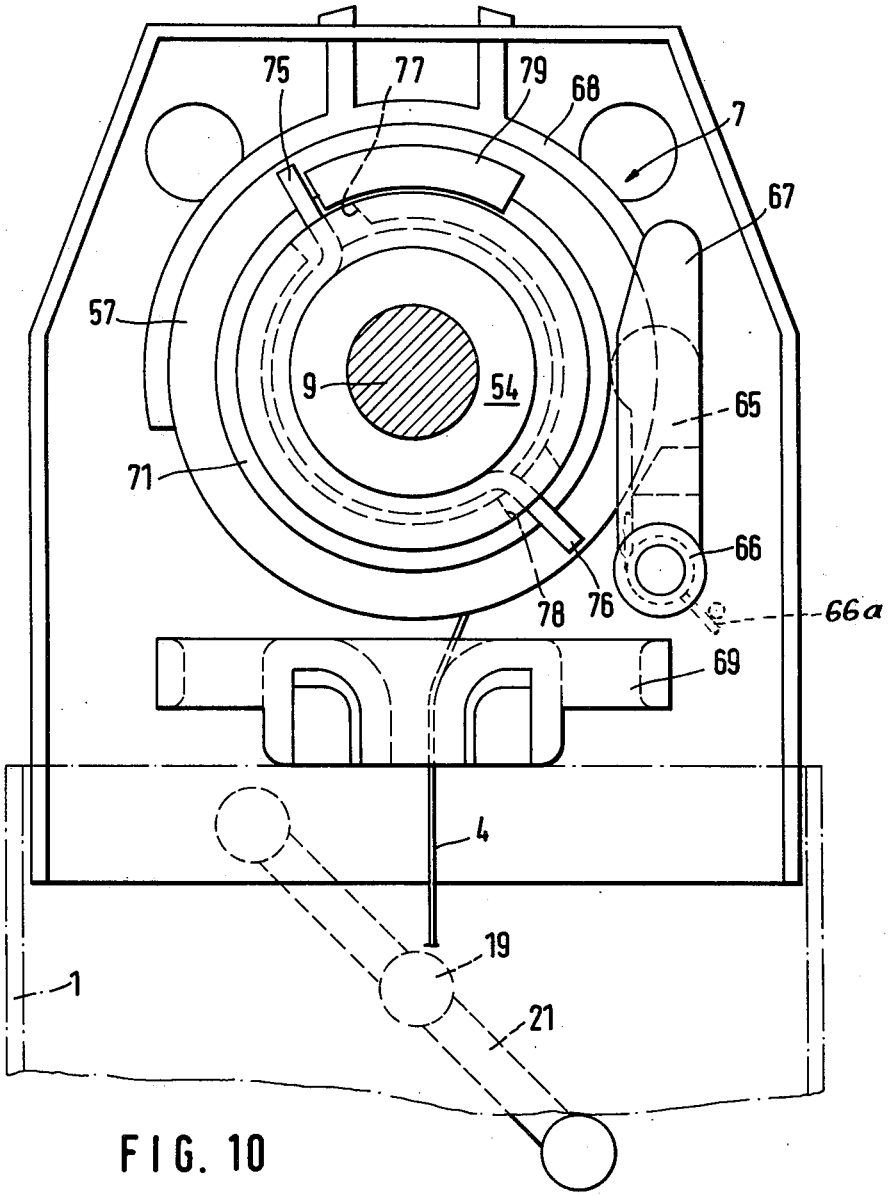
FIG. 10 is a sectional view substantially as seen in the direction of arrows from the line X-X of FIG. 9 but with one of the bearings for the main shaft omitted.

The cam 64 is adjacent to one axial end of the reel 58. The other axial end of this reel is adjacent to a ring-shaped first clutch element or clutch ring 70 which is freely rotatable on the sleeve 54. That portion of the ring 70 which is disposed between the left-hand flange 57 (as viewed in FIG. 9) and a ring-shaped collar 71 of the ring 70 has a frustoconical external surface 72 serving to support the tilting bands 5. The collar 71 forms or can form an integral part of the ring 70. FIGS. 8 and 9 show that the tilting bands 5 can constitute cords, cables or strings of circular cross section. The two bands 5 are connected to each other and form a loop on the frustoconical surface 72 of the ring 70. The looped portions of the tilting bands 5 are or can be in frictional engagement with the surface 72. However, it is also possible to replace the frustoconical surface 72 with a cylindrical surface and to secure the tilting bands 5 to the collar 71. In the embodiment which is shown in FIGS. 8 to 10, the bands 5 tend to slide against the collar 71 of the ring 70 because the surface 72 is conical and its diameter decreases in a direction toward the collar 71 so that the looped portions of the bands 5 tend to become wedged in the space between the left-hand end of the surface 72 (as viewed in FIG. 9) and the collar 71. If the surface 72 is cylindrical, the collar 71 can be provided with a bitt-like anchoring element (not specifically shown but analogous to the member 59) to which the tapes or bands 5 are positively connected.

The end portion of the clutch ring 70 which is remote from the collar 71 is radially spaced from the adjacent portion of the peripheral surface of the sleeve 54 so that the parts 54 and 70 define an annular chamber 73 for the convolutions of a second clutch element here shown as a coil spring 74. The latter is in frictional engagement with the peripheral surface of the sleeve 54 and has two end portions 75, 76 which extend radially outwardly (see particularly FIG. 10). The end portions 75 and 76 are angularly offset from each other through a predetermined distance (as considered in the circumferential direction of the ring 70 and sleeve 54) and respectively extend through slots 77 and 78 which are machined into or otherwise formed in the clutch ring 70. In the illustrated embodiment, the end portions 75, 76 of the coil spring 74 are located substantially diametrically opposite each other.

The spring 74 receives torque from the sleeve 54 (when the latter is rotated by the main shaft 9) and transmits torque to the clutch ring 70 until one of the end portions 75, 76 encounters a movement-interrupting stop 79 which is installed in or forms part of the housing 6. As shown in FIG. 10, the stop 79 has an arcuate shape and includes two end faces extending substantially radially of the main shaft 9; one of these end faces can arrest the end portion 75 and the other of these end faces can arrest the end portion 76 of the coil spring 74. Frictional engagement between the convolutions of the spring 74 and the peripheral surface of the sleeve 54 is terminated or overcome as soon as the stop 79 arrests one of the end portions 75, 76.

When the stop 79 arrests the end portion 75 of the spring 74, the planes 30 of the slats 3 or 3' are horizontal or practically horizontal. On the other hand, the curtain of slats 3 or 3' is closed when the stop 79 intercepts the end portion 76 of the spring 74.

When the lever 67 assumes the angular position which is shown in FIG. 10 (at such time, the follower lever 65 tracks that portion of the cam face **64*a* which is located at a minimum distance from the axis of the main shaft 9), the lever 67 extends into the path of movement of the end portion 76 of the spring 74 and constitutes an additional movement-interrupting stop. Thus, if the end portion 76 strikes against the lever 67, the latter performs the same function as the stop 79, i.e., it terminates or overcomes the frictional engagement between the peripheral surface of the sleeve 54 and the convolutions of the spring 74 so that the torque-transmitting connection between the sleeve 54 and the clutch ring 70 is interrupted. The slats 3 or 3' then assume predetermined (working) positions in which their planes 30 are slightly inclined to the horizontal. Such situation will arise during the initial stage of lowering of the slat curtain (as mentioned above, the planes 30 of the slats 3 or 3' are horizontal when the length of the curtain is reduced to a minimum in response to lifting of the lowermost slat to its uppermost position). During the initial stage of lowering of slats from their upper end positions, the clutch spring 74 and the clutch ring 70 rotate in a counterclockwise direction, as viewed in FIG. 10, whereby the drum including the frustoconical surface 72 and the collar 71 of the ring 70 moves the tilting bands 5 lengthwise in a direction to effect a closing of the curtain of slats 3 or 3' until the slats assume the aforementioned slightly inclined or partially closed working positions. At such time, the end portion 76 of the spring 74 reaches and is arrrested by the lever 67. During further lowering of the curtain of slats 3 or 3', the slats remain in the slightly inclined "working" positions until they reach their lower end positions, i.e., until the lifting band 4 is fully paid out by the reel 58 so that the Z-shaped spring 61 can assume the position which is shown in FIG. 9 and its righthand end portion or leg establishes a torque-transmitting connection between the reel 58 (sleeve 54) and the cam 64. The cam 64 then rotates with the sleeve 54 whereby the lever 65 tracks a portion of the cam face 64*a* whose distance from the axis of the main shaft 9 increases. The lever 65 then turns the shaft 66 which causes the lever 67 to leave the path of movement of the end portion 76 of the spring 74. Consequently, the end portion 76 resumes its angular movement and advances toward and into engagement with the respective end face of the stop 79. When the lever 67 releases the end portion 76 of the spring 74, the reel or drum including the frustoconical surface 72 of the ring 70 rotates with the sleeve 54 and changes the positions of the tilting bands 5 in a direction to move the slats 3 or 3' to the fully closed positions. When the curtain of slats is fully extended, the slats 3 or 3' are free to pivot between fully open or fully closed positions because the lever 67 is then remote from the path of movement of the end portion 76 of the spring 74**.

During the initial stage of lifting of the curtain of slats, the clutch spring 74, the clutch ring 70 and the drum including the surface 72 of the ring 70 (i.e., the means for moving the tilting bands 5 lengthwise) rotate with the sleeve 54 (which is rotated by the main shaft 9) until the slats 3 or 3' reassume their horizontal positions. At such time, the end portion 75 of the spring 74 strikes against the stop 79 to terminate or to overcome the frictional engagement between the external surface of the sleeve 54 and the convolutions of the spring 74. At the same time, the lifting band 4 pushes the median portion of the Z-shaped spring 61 back into the groove 60 of the sleeve 54 (i.e., toward the axis of the shaft 9) so that the cam 64 ceases to rotate with the sleeve 54 while the operator continues to lift the curtain of slats 3 or 3'.

The extent to which the spring 74 can turn relative to the stop 79 corresponds to the extent of angular movement of slats 3 or 3' between their fully open and fully closed positions.

A blind or shutter with a spring somewhat similar to the spring 61 is disclosed in commonly owned U.S. Pat. No. 4,088,171 granted May 9, 1978 to Rene Schluep et al. The disclosure of this patent is incorporated herein by reference.

An advantage of the mechanism 7 which is shown in FIGS. 8 to 10 is that the slat lifting unit (reel 58) can be placed into immediate or close proximity of the slat tilting unit (ring 70 including the surface 72). In other words, the band 4 can be located close to the bands 5, and the dimensions of the guide rails 1 can be reduced accordingly.

The lever 67 can be used with one or more additional levers mounted on the shaft 66 and extending into the path of movement of the end portion 76 of the spring 74 in certain angular positions of the cam 64 which determines the angular positions of the lever 65 and shaft 66.

Such arrangement renders it possible to move the slats 3 or 3' to any one of two or more different "working" positions by temporarily arresting the end portion 76 of the spring 74 at any one of two or more different distances from the stop 79. As explained above, retention of slats 3 or 3' in partly open "working" positions ensures that the room is not completely or nearly completely dark during lowering of the curtain. On the other hand, the room can be darkened by pivoting the slats 3 or 3' to fully closed positions as soon as the lowermost slat reaches its lower end position.

The utilization of spring 61, shaft 66 with levers 65, 67 and cam 64 contributes to compactness of the mechanism 7 and renders it possible to install such mechanism at a level directly above a guide rail 1 having a surprisingly small cross-sectional area. Moreover, the units which respectively lift the slats (via band 4) and tilt the slats (via band or bands 5) can be placed into immediate proximity to each other.

The cam 64 and the shaft 66 with its levers 65, 67 can be removed if the feature of holding the slats 3 or 3' in "working" positions during lowering of the curtain is not desired or is unnecessary. The mechanism 7 can be designed in such a way that the parts 64 to 67 can be installed therein subsequent to completion of assembly of all other components of the shutter.

The bracket-like housing 6 of FIGS. 8 to 10 constitutes an enclosure or casing for the mechanism 7 because it mounts the sleeve 54 and the parts which are mounted on such sleeve, and also because such housing 6 accommodates and supports the shaft 66 and the stop 79. However, it is equally possible to install the sleeve 54, the shaft 66 and the stop 79 in a discrete frame or casing and to install the mechanism 7, as a prefabricated unit which includes the just mentioned frame or casing, in the housing 6.

In accordance with a presently preferred technique, the housings 6, with the mechanisms 7 already installed therein, are transported to the building with other parts (such as shaft 9, bands 4, 5, guide rails 1 and shroud 15 or 16) which are still in the form of yard goods or piece goods. When the bands 4 and 5 are cut to required size, the levers 21 of the slat holders 18 or 18' are connected with the bands 5 and, after the guide rails 1 are cut to size, the levers 21 and the bands 4, 5 are introduced into the respective compartments **1*b* before the housings 6 are slipped onto or into the upper end portions of the corresponding guide rails 1. The guide rails 1 are thereupon affixed to the building before the main shaft 9 is installed in and between the housings 6. However, the shaft 9 can be mounted in the housings 6 prior to securing of guide rails 1 to the building. The gear case 10 and the crank drive 13 are mounted in the next step (unless the shaft 9 is to be driven exclusively automatically). In the final step, the slats 3 or 3' are cut to size, and their end portions 3*a* or 3*a'* are assembled with the corresponding holders 18 or 18'**.

An important advantage of the improved modular shutter is that its component parts can be used to assemble a highly satisfactory shutter irrespective of the size of the opening in which the shutter is to be installed. Thus, one and the same kit can be used to assemble a shutter for a large or a small window or door opening, and all such component parts whose dimensions depend on the size of the opening can be furnished in the form of yard goods and cut to size at the locale of assembly. Moreover, the component parts of the kit can be cut to size and assembled by non-professionals, e.g., by tinkers who purchase a complete do-it-yourself kit with short instructions, if any, regarding the selection of dimensions of shaft 9, guide rails 1, bands 4, 5 and shroud 15 or 16 prior to installation of the shutter in a window opening or the like.

For the manufacturer, the improved shutter exhibits the advantage that the manufacturer can accumulate a large inventory of prefabricated component parts which can be stored in a small area. There is no need to carry out measurements prior to transport of a kit to the locale of use, and the assembly can be readily entrusted to semiskilled employees of the manufacturer, or can be performed by the employees of the builder or by the owner of the building. The mass production of component parts for inventory and convenient storage of such parts contribute significantly to a reduction of the initial cost of the improved shutter.

The aforementioned quick make-and-break connections constitute but a few of those devices which can be employed to connect the component parts of the improved kit (or the constituents of such component parts) to each other. It is further possible to employ more or less permanent connectors, such as rivets, welded or soldered seams, adhesive bonds or the like without departing from the spirit of the invention.

The assembling of each mechanism 7 and the corresponding housing 6 into a self-sustaining structural unit or component part of the improved kit exhibits the advantage that the component of maximum complexity (i.e., that component which would be most likely to baffle a do-it-yourself man or a semiskilled or unskilled employee of a shutter manufacturer or a builder) can be fully assembled at the plant in such a way that improper assembly of such part with the main shaft 9 and/or with the guide rails 1 is highly unlikely. As explained above, the means for limiting the extent of pivotal and/or upward and downward movement of the slats 3 or 3' can be installed in the housing or housings 6 (or in the shroud 15 or 16) so that such task is also performed at the plant with attendant further reduction of the likelihood or improper assembly of the shutter by a semiskilled or unskilled person.

The mounting of bearings 8 in the housings 6 is an indirect indication to the erector as to the correct mode of assembling such housings with the main shaft 9. The clamps 14 can be numbered or otherwise identified so as to inform the user or erector of their purpose, namely, to connect the shroud 15 or 16 with one or both housings 6 as soon as the shroud has been cut to required size. The aforediscussed construction of the gear case 10 is also intended to enable a man having average or even minimal skill to properly mount the gear case 10 on the one or the other end portion of the main shaft 9 as well as to properly couple the gear case with the output element 12 of the crank drive 13.

Any suitable type of prime mover means, e.g., a reversible prime mover having an output element which can be non-rotatably slipped onto or received in the one or the other end portion of the shaft 9. It is further possible to provide a discrete component part which constitutes a means for transmitting torque from the prime mover to the main shaft 9.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A shutter for doors, windows or the like comprising a plurality of prefabricated components including a curtain of liftable and tiltable slats having a lowermost slat, hollow guide rails for said slats, housings attached to said guide rails, a horizontal main shaft rotatably mounted in said housings, and means for rotating said shaft clockwise and counterclockwise, said components including quick make-and-break connections for attachment of cooperating components to each other, and at least one of said housings and the corresponding guide rail comprising a slat tilting and lifting mechanism, said mechanism including a carriage movable up and down in said corresponding guide rail, a flexible element movable up and down in response to rotation of said shaft in the respective directions, means for connecting said flexible element to said carriage, and means for coupling said lowermost slat to said carriage.

2. The shutter of claim 1, wherein each of said housings comprises at least one bearing for said shaft.

3. The shutter of claim 1, wherein said components further comprise a shroud at least partially surrounding said shaft, said connections including at least one clamping device for each of said housings, and said clamping devices being arranged to connect said shroud with the respective housings.

4. The shutter of claim 1, wherein said components include a gear case separably connected with said shaft and including said rotating means, and manually actuable drive means for said rotating means.

5. The shutter of claim 4, wherein said connections include means for securing said gear case to one of said housings and said drive means includes a crank drive.

6. The shutter of claim 4, wherein said rotating means comprises an angular gear having an output element nonrotatably connected with said shaft.

7. The shutter of claim 1, wherein said mechanism includes a sleeve surrounding a portion of and receiving torque from said shaft.

8. The shutter of claim 7, wherein said one housing has at least one bearing rotatably mounting said sleeve.

9. The shutter of claim 1, wherein said one end lowermost slat and said carriage comprise cooperating levelling means for said lowermost slat.

10. The shutter of claim 9, wherein said lowermost slat has a longitudinal axis and said levelling means comprise a first part coaxial with said lowermost slat and a second part mounted in said carriage at a level below said first part, said first and second parts having surfaces which abut against each other in the lowermost position of said lowermost slat so that such slat then assumes an inclination which is determined by said surfaces.

11. The shutter of claim 10, wherein said surfaces maintain said lowermost slat in a substantially horizontal position when said first part is caused to rest on said second part.

12. The shutter of claim 10, wherein said first part is a stub and said carriage has a bearing rotatably and vertically movably receiving said stub.

13. The shutter of claim 10, wherein one of said parts has a groove and the other of said parts has a projection receivable in said groove, said surfaces respectively bounding said groove and said projection.

14. The shutter of claim 13, wherein said projection is a wedge and said groove has a substantially V-shaped outline.

15. The shutter of claim 1, wherein said guide rails extend substantially vertically so as to flank said slats, said guide rails further having vertical slots adjacent to the respective end portions of said slats; and further comprising a holder for each end portion of each slat, each of said holders comprising a first portion separably connected with the respective end portion of the corresponding slat and a second portion extending through the respective slot and into the interior of the adjacent hollow guide rail.

16. The shutter of claim 15, wherein each of said holders constitutes one of said components, said first portion of each holder comprising a plate-like cover member separably secured to the respective end portion of the corresponding slat and said second portion of each holder comprising a pivot pin rigid with the respective cover member and extending through the slot of the adjacent guide rail.

17. The shutter of claim 16, wherein said first portion of each holder further comprises a detent member rigid with the respective pivot pin and overlapped by the respective end portion of the corresponding slat so that such end portion is disposed between the cover member and the detent member of the first portion of the respective holder.

18. The shutter of claim 17, wherein the first portion of each of said holders further comprises an insert interposed between the respective end portion of the corresponding slat and the detent member.

19. The shutter of claim 18, wherein the first portion of each of said holders further comprises means for releasably coupling the detent member with the respective insert.

20. The shutter of claim 18, wherein each insert defines with the corresponding cover member a space for at least substantially clearance-free reception of the respective end portion of the corresponding slat.

21. The shutter of claim 18, further comprising means for releasably coupling each insert with the respective end portion of the corresponding slat.

22. The shutter of claim 21, wherein said coupling means comprises an elastically deformable protuberance on each insert and a complementary opening provided in the respective end portion of the corresponding shutter for reception of the protuberance.

23. The shutter of claim 15, wherein the second portions of holders for the lowermost slat comprise stubs; and said carriage has a bearing rotatably and vertically movably receiving a respective stub.

24. The shutter of claim 23, wherein the second portions of holders for said lowermost slat further comprise pivot pins extending through the respective slots, said stubs being coaxial and integral with the respective pivot pins.

25. The shutter of claim 1, wherein said flexible element extends into the corresponding guide rail and has equidistant studs provided thereon, said components further including holders for the end portions of said slats, and such holders including levers installed in and movable up and down in said guide rails, said levers having sockets for said studs.

26. The shutter of claim 1, wherein said components are designed for installation in openings having a range of sizes.

27. The shutter of claim 1, wherein said additional components comprise holders for said slats.

28. The shutter of claim 1, wherein said flexible component is elongated.

29. The shutter of claim 1, wherein said severed components comprise an elongated element for tilting said slats.

30. The shutter of claim 1, wherein said components comprise a shroud for said shaft.

31. A shutter for doors, windows or the like comprising a plurality of prefabricated components including a curtain of liftable and tiltable slats, guide rails for said slats, housings attached to said guide rails, and a rotary main shaft rotatably mounted in said housings, said components including quick make-and-break connections for attachment of cooperating components to each other, and at least one of said housings comprising a combined lifting and tilting mechanism for said slats, said mechanism including a sleeve surrounding a portion of and receiving torque from said shaft, at least one flexible slat-tilting element extending downwardly into one of said guide rails, a ring-shaped first clutch element rotatably mounted on said sleeve and arranged to move said flexible element lengthwise in response to rotation thereof to thereby change the inclination of said slats, a second clutch element interposed between said sleeve and said first clutch element and arranged to transmit torque to said first clutch element in response to rotation of said sleeve and said shaft, and means for interrupting the transmission of torque from said sleeve to said first clutch element in predetermined angular positions of said first clutch element.

32. The shutter of claim 31, wherein said sleeve and said first clutch element define an annular chamber and said second clutch element comprises a coil spring having convolutions normally frictionally engaging said sleeve and angularly offset end portions extending outwardly through and beyond slots provided therefor in said first clutch element, said interrupting means including stop means provided in said one housing and located in the path of movement of the end portions of said spring.

33. The shutter of claim 33, further comprising means for rotating said shaft clockwise and counterclockwise so that one end portion of said spring engages said stop means in response to clockwise rotation and the other end portion of said spring engages said stop means in response to counterclockwise rotation of said shaft, the extent of angular movement of said first clutch element while one end portion of the spring moves away from and until the other end portion of the spring engages said stop means determining the extent of tilting of said slats between fully open and closed positions.

34. The shutter of claim 33, wherein said interrupting means comprises additional stop means and adjusting means for moving said additional stop means into the path of movement of at least one end portion of said spring in at least one predetermined angular position of said sleeve so that said first clutch element is disengaged from said sleeve while said slats assume partly open positions.

35. The shutter of claim 34, wherein said adjusting means comprises a cam rotatable with reference to said sleeve, resilient means for releasably coupling said cam with said sleeve when said slats assume their lowermost positions, follower means tracking said cam, and means for connecting said follower means to said additional stop means.

36. The shutter of claim 35, wherein said cam is a disc cam having a peripheral cam face and said follower means comprises a pivotable lever engaging said cam face, said connecting means between said follower means and said additional stop means comprising a second shaft rotatably mounted in said one housing and rigid with said lever, said additional stop means comprising a second lever rigid with said second shaft.

* * * * *